US006123222A

United States Patent [19]

Richiger et al.

[11] Patent Number: 6,123,222

[45] Date of Patent: Sep. 26, 2000

[54] PACKAGE AND SYSTEM FOR DISPENSING PREFORMED NURSER SAC

[75] Inventors: David B. Richiger, Ridgefield, Conn.; Salvatore J. Leone, Dover, Del.; Emanuel P. Morano, Totowa, N.J.; Anthony E. Flecknoe-Brown, Richmond, Australia

[73] Assignee: Playtex Products, Inc., Westport, Conn.

[21] Appl. No.: 09/177,017

[22] Filed: Oct. 22, 1998

Related U.S. Application Data

[63] Continuation of application No. 08/587,873, Jan. 11, 1996, abandoned, which is a continuation of application No. 08/218,314, Mar. 25, 1994, Pat. No. 5,501,365.

[51] Int. Cl.[7] ..... A47K 10/24

[52] U.S. Cl. ..... 221/45; 221/63

[58] Field of Search ..... 221/63, 45, 49, 221/33, 303, 309; 206/512, 554

[56] References Cited

U.S. PATENT DOCUMENTS 5,310,057 5/1994 Caldwell et al. ..... 221/63

5,501,365 3/1996 Richiger et al. ..... 221/63

*Primary Examiner*—Kenneth W. Noland

*Attorney, Agent, or Firm*—Ohlandt, Greely, Ruggiero & Perle, L.L.P.

[57] ABSTRACT

There is provided a system for dispensing a plurality of nurser liners one at a time. The system includes a dispenser having a bottom wall with an edge that defines a flap, and a plurality of nurser liners stacked in a nesting arrangement. The flap is adapted to move from a first position to a second position in which the flap exposes an aperture in the bottom wall. Each one of the plurality of nurser liners has a single open end, and the open end has a flexible rim with a diameter greater than that of the aperture. The plurality of nurser liners are positioned so that the rims are adjacent the aperture with a lowermost one of the plurality of nurser liners abutting the edge. Accordingly, the edge acts as a dual-sided guide for deflecting the rim inward of the lowermost nurser liner as the rim passes through the aperture, and restricts the remainder of the plurality of nurser liners from moving with the lowermost nurser liner out of the dispenser to overcome friction forces caused by the nesting arrangement.

1 Claim, 6 Drawing Sheets

PACKAGE AND SYSTEM FOR DISPENSING PREFORMED NURSER SAC

This is a continuation of U.S. patent application Ser. No. 08/587,873, filed Jan. 11, 1996, now abandoned, which is a continuation of U.S. patent application Ser. No. 08/218,314, filed on Mar. 25, 1994, titled A PACKAGE AND SYSTEM FOR DISPENSING PREFORMED NURSER SACS, which issued into U.S. Pat. No. 5,501,365 on Mar. 26, 1996.

BACKGROUND OF THE INVENTION

1. Field of the Invention

This invention relates to dispensers, and more particularly, to a package and system for dispensing preformed nurser liners or sacs. The package, which is also used to transport the disposable preformed bottles, is particularly suited for dispensing stacked, nested, tapered substantially cylindrical nurser liners. It provides for the individual dispensing of liners in a sanitary fashion and without any undue pressure on the liner. Moreover, the dispenser is the package itself and interchangeably encloses the nurser liners or permits individual dispensing of same. In fact, the dispenser and means for dispensing the liners is one integral cardboard member.

The use of disposable liners or sacs in nurser bottles is primarily due to the concern over possible contamination of milk and other liquids contained in the nurser bottle. The liners are preformed, pre-sterilized and disposable and, whether collapsible or not, require holders to support them during their use within a nurser bottle or assembly. Accordingly, the nurser liners have a rather firm, but flexible, circumferential rim to support the liner in the holder.

With the advent of the expanded use of disposable liners, a need developed for a dispenser that stores, protects from contamination and transports the liners and, preferably, can also be used to dispense the liners. A common problem has been the amount of package and shelf space that can be allocated to hold a plurality of liners. To minimize the amount of space, the liners have been stacked one upon another. However, this stacking arrangement creates another problem. The frictional surface contact between adjacent liners can cause more than one liner to dispense at a time. In addition, since the liner is a one use or disposable product, it is relatively inexpensive. Thus, the packaging for this item must be cost effective.

To obtain the balance of an inexpensive dispenser that protects the liners during transportation and can hold a relatively large number of liners in a relatively small amount of space, yet provide the individual dispensing of liners without contamination, the present dispenser system, package and method of dispensing liners have been developed.

2. Description of the Prior Art

Nurser liners that have an upper, firm flange to facilitate the positioning and assembly of the liner with the holder are shown in U.S. Pat. No. 958,328 to Decker, which issued on Feb. 28, 1911; U.S. Pat. No. 2,110,928 to De Buys, which issued on Mar. 15, 1938; U.S. Pat. No. 2,508,481 to Allen, which issued on May 23, 1950; and U.S. Pat. No. 3,776,408 to Wald, which issued on Dec. 4, 1973.

Containers for dispensing generally tapered items, such as ice cream cones, cup pastry and paper cups, are also known. The tapered items are nested in a vertical stack, and retaining elements at or near the bottom aperture of the container support the lowermost tapered item so that a substantial portion of the narrow end of the lowermost tapered item is accessible from the outside of the container. The item is dispensed by gripping it with one's entire hand and pulling the tapered item down from the container. The grip must be tight enough to remove the tapered item from the container, but not so tight as to damage the tapered item.

Such containment systems are shown in U.S. Pat. No. 1,388,977, to Stephens, which issued on Aug. 30, 1921; U.S. Pat. No. 1,429,701, also to Stephens, which issued on Sep. 19, 1922; U.S. Pat. No. 1,633,983, to Dawson, et al., which issued on Jun. 28, 1927; U.S. Pat. No. 2,319,975, to Buttery, which issued on May 25, 1943; U.S. Pat. No. 2,323,841, to Pape, et al., which issued on Jul. 6, 1943; U.S. Pat. No. 2,340,090 to Vineburg, which issued on Jan. 25, 1944; U.S. Pat. No. 2,360,765 to Davidson, which issued on Oct. 17, 1944; U.S. Pat. No. 2,369,933 to Amberg, which issued on Feb. 20, 1945; and U.S. Pat. No. 2,926,813 to Marion, which issued on Mar. 1, 1960. See also, U.S. Design Pat. No. 225,266 to Cousins, which issued on Nov. 28, 1972; U.S. Design Pat. No. 286,109 to Cosby, et al., which issued on Oct. 14, 1986; and U.S. Design Pat. No. 298,394 to Brewer, which issued on Nov. 8, 1988.

These patents all fail to provide an easy and sanitary dispenser since such a grip can damage the tapered item and, moreover, contaminate the item.

Some patents, such as U.S. Pat. No. 1,151,064 to Swift, which issued on Aug. 24, 1915, U.S. Pat. No. 1,698,239 to Morin, which issued on Jan. 8, 1929, U.S. Pat. No. 4,266,665 to Nelson, which issued on May 12, 1981, and U.S. Pat. No. 4,739,902 to Joslyn, et al., which issued on Apr. 26, 1988, are directed to containers that have movable components to facilitate the removal of items. These devices have complex, movable parts that are subject to breakdowns and wear and tear. Also, these containers are not economically feasible.

Other containers for dispensing stacked items are stationary units and require that the dispensed item have some means or portion to facilitate dispensing. For example, U.S. Pat. No. 4,550,856 to Ballmann, et al., which issued on Nov. 5, 1985, provides a retainer for dispensing disposable face masks in which the dispensed items have a strap securely attached to facilitate dispensing. U.S. Pat. No. 4,476,996 to Moore, Jr., et al., which issued on Oct. 16, 1984, and U.S. Pat. No. 4,580,696 to Moore, Jr., et al., which issued on Apr. 8, 1986, provide a nested stack of cups positioned with respect to a dispensing person such that the back wall of each cup is directed away from the dispensing person and rests on two abutments at the bottom of the dispenser. To remove a cup from the nested stack, the extending back wall of the lowermost cup is grasped by a person's fingers and is shifted forward so that the lowermost cup is pulled downwardly from the stack of cups and from the abutments. These containers fail to dispense a flexible item that assists in the dispensing process and, therefore, they must be shifted before they can be removed.

U.S. Pat. No. 4,094,443 to Whelan, which issued on Jun. 13, 1978, is directed to cone-shaped paint filters that have extended ears to facilitate their dispensing from a container. Similarly, U.S. Pat. No. 4,483,460 also to Whelan, which issued on Nov. 20, 1984, also provides a device for dispensing cone-shaped paint filters having extended ears. U.S. Pat. No. 2,455,685 to Lehman, which issued on Dec. 7, 1948, provides a match box. To dispense a match from the match box, a person's finger and thumb may reach the match through the finger-receiving openings and forcibly remove the match. The match is not resilient or elastic in character, and a two-part container is necessary. These patents, as those discussed above, fail to suggest dispensing of a flexible item.

Further, not one of the above patents provide a containment unit for the storing, protecting, transporting, and dispensing of nurser liners. As also stated above, most of these containers require a person to grab the body of each tapered item which is not feasible for dispensing flexible, collapsible liners. Also, some patents disclose mechanical dispensing units that have moving parts that greatly increase the cost of the dispenser. Still further, not one of these patents takes advantage of the resiliency of the nurser liners in order to provide a simple and inexpensive container. Basically, if the mechanical dispensing units do not have moving parts, the dispensed items must be shifted-off of the additional abutments or tabs and thereafter removed from the container.

U.S. Pat. No. 4,874,112 to Mulder, et al., which issued on Oct. 17, 1989, provides a filter container having a bottom opening and side openings that are continuous with the bottom opening. The side openings are just large enough for tabs of the filter paper to extend through so that a person may access the tabs.

U.S. Pat. No. 4,930,662 to Carrillo, which issued on Jun. 5, 1990, describes a container that employs the flexibility of paper, plastic or foam plates to dispense such items. The container holds stacked flexible plates in an upright orientation. The lowermost plate is supported in a bottom aperture by an inwardly-directed peripheral flange extending approximately 230 degrees around the circumference of the aperture. The flexible plates are also supported in this position by two inwardly-directed peripheral tabs that are situated along the circumference of the aperture away from the flange. The lowermost plate is dispensed by grasping its rim edge portion through the side aperture by a finger or thumb and pulling down past the tabs. The warping action of the dishes permits the dishes to be pulled down beyond engagement with the tabs and slide radially outward through the bottom aperture of the container.

In summary, not one of the aforementioned patents provides a dispenser for nurser liners. Moreover, these patents also do not minimize the costs of the materials and assembly by just using the structure of the dispenser body itself.

SUMMARY OF THE INVENTION

It is an object of the present invention to provide a dispenser that stores, protects, transports and dispenses one at a time a plurality of nurser liners.

It is another object of the present invention to provide such a dispenser that provides an easy, yet sanitary dispensing of nurser liners.

It is still another object of the present invention to provide such a dispenser that utilizes a single, integral sheet of cardboard and, thus, is economical and simple to manufacture, and process using standard, high speed cartoning equipment, to "square up" the dispenser, and load and seal.

It is yet another object of the present invention to provide such a dispenser that utilizes the inherent properties of the nurser liners to facilitate dispensing.

These and other objects of the present invention are provided by a system for dispensing a plurality of nurser liners one at a time. The system comprises a dispenser having a bottom wall with an edge that defines a flap, and a plurality of nurser liners stacked in a nesting arrangement, with each one of the plurality of nurser liners having a single open end. The flap is adapted to move from a first position to a second position in which the flap exposes an aperture in the bottom wall. Each open end has a flexible rim with a diameter greater than that of the aperture. The plurality of nurser liners are positioned so that the rims are adjacent the aperture with a lowermost one of the plurality of nurser liners abutting the edge. Significantly, the edge acts as a guide for deflecting the rim inward of the lowermost nurser liner as the rim passes through the aperture, and restricts the remainder of the plurality of nurser liners from moving with the lowermost nurser liner out of the dispenser, thus, overcoming the friction forces caused by the nesting arrangement.

When the flap is moved back to its first position, it is secured in place in a closed position by means of friction between the distal edges of the flap and the edge of the bottom wall.

The present invention is also directed to a dispenser for dispensing individual nurser liners from a stack of a plurality of nurser liners each nurser liner having a flexible, circumferential rim at its open end. The dispenser comprises a body having a front wall, a pair of side walls connected to the front wall, a back wall connected to the pair of side walls, a bottom wall and a top wall connected the back wall. The body forms, in its assembled condition, a closed body that is adapted to receive the stack of the plurality of nurser liners. The front wall is connected to the bottom wall. The front wall and bottom wall each have a perforated edge portion that defines a single flap that is adapted to move from a first closed position to a second open position that exposes an aperture in the front wall and the bottom wall. The dispenser also comprises means for positioning the stack of the plurality of nurser liners in an inverted position in alignment with the aperture.

The present invention is further directed to a method for dispensing individual nurser liners from a stack of a plurality of nurser liners each having a flexible, circumferential rim at its open end in which the stack is positioned in a dispenser having a bottom wall and a front wall each with a perforated edge portion. The perforated edge portions define a flap that selectively moves from a first position to a second position in which a dispensing aperture through the dispenser is exposed. The method comprises the steps of: positioning the stack of the plurality of nurser liners vertically within the dispenser so that the rim the lowermost one of the plurality of nurser liners is supported by the edge; grasping through the dispensing aperture a portion of the rim of the lowermost one of the plurality of nurser liners; and withdrawing the portion outward through the dispensing aperture so that the remainder of the lowermost one of the plurality of nurser liners withdraws through the dispensing aperture subsequent to the rim.

The above, and other objects, features and advantages of the present invention will become apparent from the following description read in conjunction with the accompanying drawings, in which like reference numerals designate the same elements.

BRIEF DESCRIPTION OF THE DRAWINGS

The foregoing and still other objects and advantages of the present invention will be more apparent from the following detailed explanation of the preferred embodiments of the invention in connection with the accompanying drawings wherein.

DETAILED DESCRIPTION OF THE PREFERRED EMBODIMENT

Figure 1:
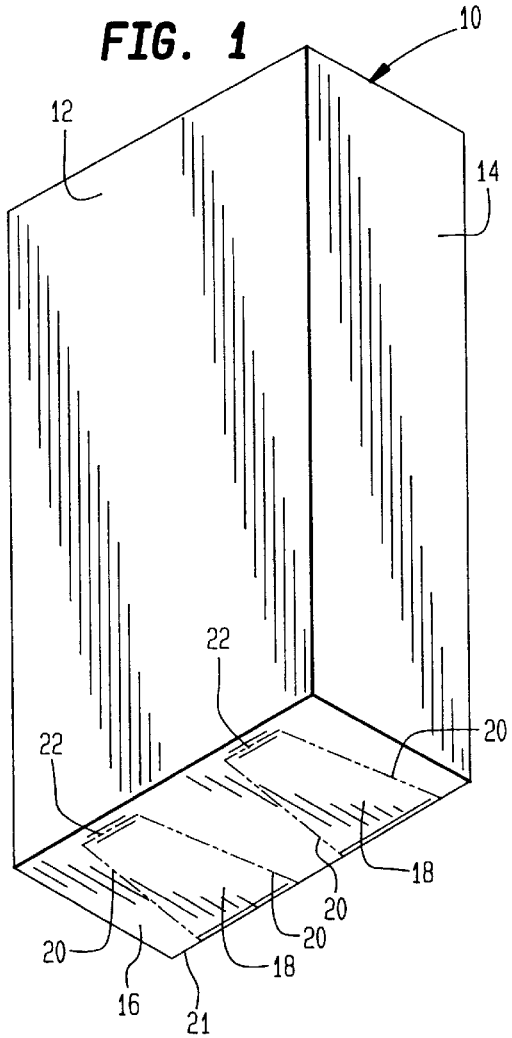
FIG. 1 is a perspective view viewed from the bottom of a dispenser of the present invention.

Referring to the figures and, in particular, FIG. 1, there is shown a preferred embodiment of the present invention having a dispenser system generally represented by reference numeral 1. The dispenser system includes a dispenser or dispenser package 10.

Figure 2:
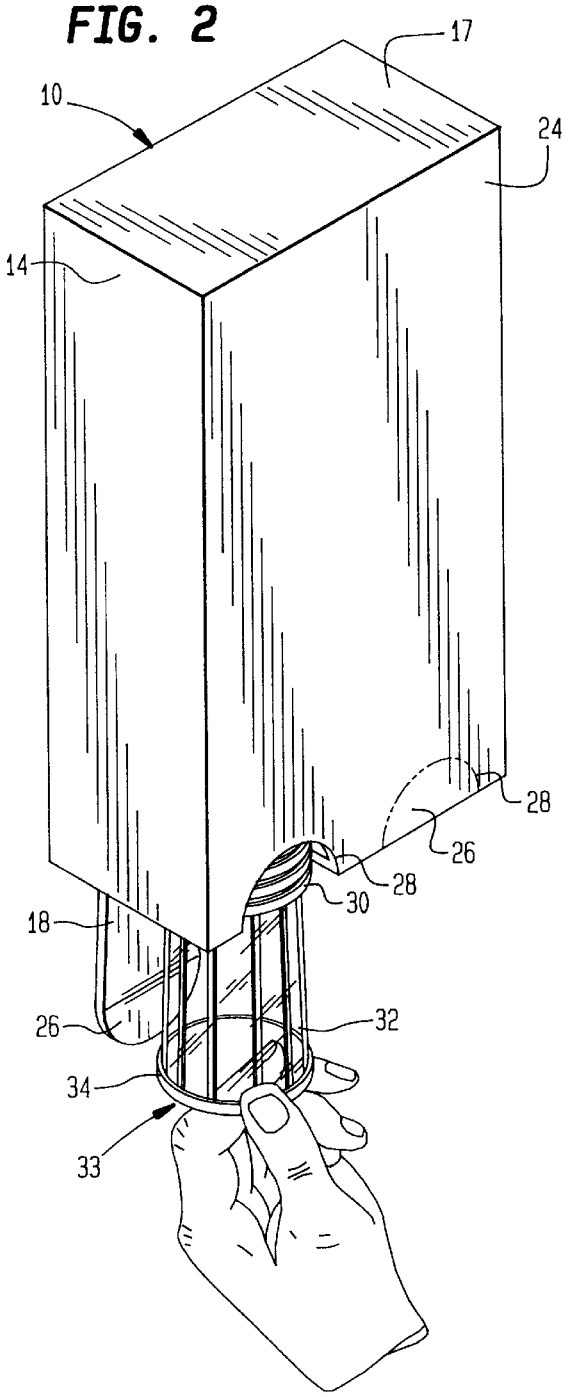
FIG. 2 is a perspective view viewed from the top of the dispenser of FIG. 1.

The dispenser 10 includes a back wall 12 and a pair of side walls 14 (only one of which is shown) that are situated approximately perpendicular to a bottom wall 16. As shown in FIG. 2, the dispenser 10 also includes a front wall 24 that is basically parallel to the back wall 12 and the side walls 14, and a top wall 17 that is basically parallel to the bottom wall 16. In its assembled condition shown in FIGS. 1 and 2, the dispenser 10 is in the form of a rectangular box.

Referring to FIG. 1, the bottom wall 16 has, in this preferred embodiment, two sets of two perforated edges 20 and a pair of hinges 22. Each set of perforated edges defines a bottom flap portion 18. Each edge of a set of two perforated edges 20 is slightly tapered with respect to the other edge so that the narrower end of each flap portion 18 terminates with each hinge 22, and forms part of the edge 21 of the bottom wall 16 and front wall 24 of the dispenser 10. The shape of each flap portion 18 is a rhombus. Referring to FIG. 2, the wider end of each flap portion 18 continues onto the front wall 24 and forms a semi-circular front flap portion 26, outlined by perforated edges 28. Accordingly, each flap, preferably, includes flap portions 18 and 26, however flap portion 26 could be eliminated provided enough room is provided to permit a user's thumb to contact the desired portion of a nurser liner as discussed below.

FIG. 2, unlike the assembled, closed dispenser 10 of FIG. 1, illustrates the assembled dispenser in an opened condition for dispensing liners. Basically, one set of perforated edges 20, and preferably 28, is pierced to provide an aperture. One flap 18/26 is opened and, thus, perforated away from the remainder of the bottom wall 16 and, preferably, front wall 24 to expose a stack 30 of nurser liners 32. The opened flap 18/26 is actually rotated on its hinge 22.

When the flap 18/26 is moved back to its first or closed position, it is secured in place in the closed position by means of friction between the edges of the flap and the perforated edges 20, 28 of the bottom wall 16.

The preferred dispenser 10 shown in FIGS. 1 through 5, houses a pair of stacks 30 of nurser liners 32. It should be understood that the dispenser 10 could be made to house a single stack 30 which would reduce the width of the package by approximately one-half and eliminate the need for a second flap 18/26.

When storing, transporting or protecting the nurser liners 32, the orientation of the dispenser 10 is not a major concern. For example, the dispenser 10 may be laid sideways within a grocery package. The orientation of the dispenser 10 becomes significant for dispensing of a nurser liner 32. During dispensing, the dispenser 10 should be in the upright position shown in FIGS. 1 and 2. Moreover, if the dispenser 10 is provided with hanging means, such as, for example, a hook, velcro or other such means, the dispenser could be characterized as being "single" handle.

The preferred embodiments of the present invention accommodate disposable liners comprised of a generally cylindrical, tapered plastic sack having an open end 33. This open end 33 has a resilient circumferential rim 34 along the entire circumference of the open end.

Other types of nurser liners may be used with the present invention, provided they have a flexible, rimmed or surfaced open end 33.

The preferred liner 32 has a rim 34 made of the same material as the reminder of the liner. However, the rim 34 is harder than the remainder of the liner 32 because it is thicker. Nonetheless, the rim 34 is still flexible, and can be flexed by the perforated edges 20 of the bottom wall 16.

Figure 10:
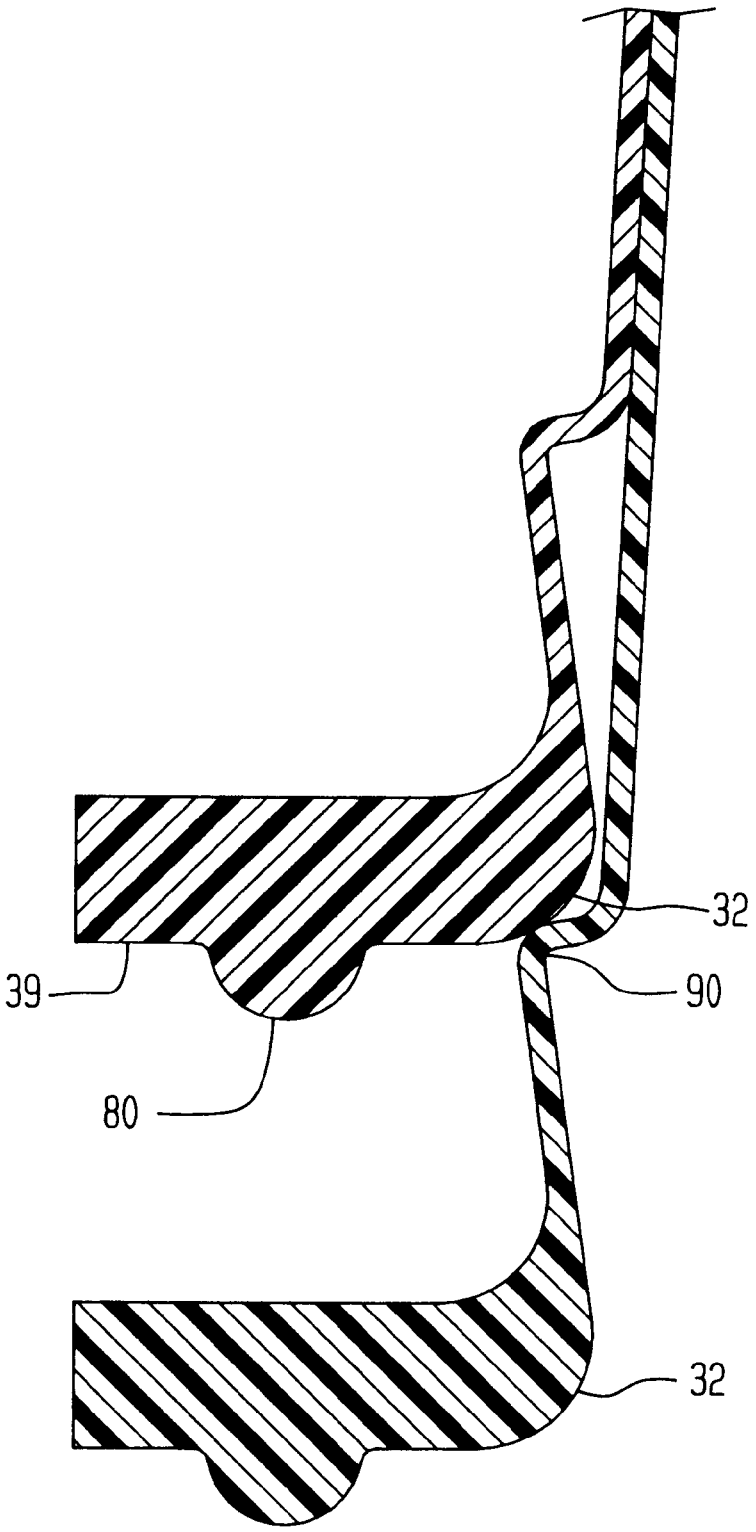
FIG. 10 is a cross-sectional view of the stacking configuration of the nurser liners in the embodiments of the present invention.

In a preferred embodiment, the liner 32 has an overall height of about 5.80 inches minus the bead 80 shown in FIG. 10. The outside diameter of the liner 32 when measured from the distal edge of the rim 34 is about 2.094 inches. The inside diameter of the liner 32 when measured from the inside surface at the rim is about 1.894 inches and an outside diameter at the terminus of the closed end of the liner is about 1.633 inches. The liner 32 has a continuous wall surface that, thus, tapers about seven degrees from the rim 34 to the closed end or bottom of the liner.

The rim 34 has a flat portion 39 shown in FIG. 10. The rim has a preferred thickness of about 0.28 inches, a preferred height of about 0.10 inches, and a preferred width or radial thickness of 0.053 inches.

The preferred liner 32 is made of polyethylene resin. A more preferred material is a low density polyethylene resin, and a most preferred material is a linear low density polyethylene resin. Such preferred resins include the DOWLEX Linear Low Density Polyethylene Resin by Dow Plastics, PE 5754 High Clarity, High Impact Film Resin by Chevron Chemical, and Escorene Low Density Polyethylene LD-103 Industrial Film Resin by Exxon Chemicals. These resins have a specific gravity between about 0.917 and about 0.940 grams per milliliter.

In the preferred embodiments, the plurality of nurser liners 32 are in two stacks and in a nesting relationship in each stack, and positioned in the dispenser 10. Each stack 30 is in a generally vertical orientation with the open end rims 34 of the liners 32 positioned adjacent the bottom 16. In this orientation, each flap 18/26 opens to the rim 34 of the lowermost liner 32 of the stack 30.

As shown in FIG. 2, the nurser liner 32 is removed from the dispenser 10 by grasping just the rim 34 of the nurser liner and pulling it in a generally downward direction through the dispensing opening formed by the removal of flap 18/26. The remaining liners 32 are immediately gravity-fed into position within the dispenser 10 adjacent to the dispensing opening. Significantly, the flap portion 26 permits the thumb and the flap portion 18 permits the forefinger of the dispensing person to readily grasp the rim 34.

Figure 3:
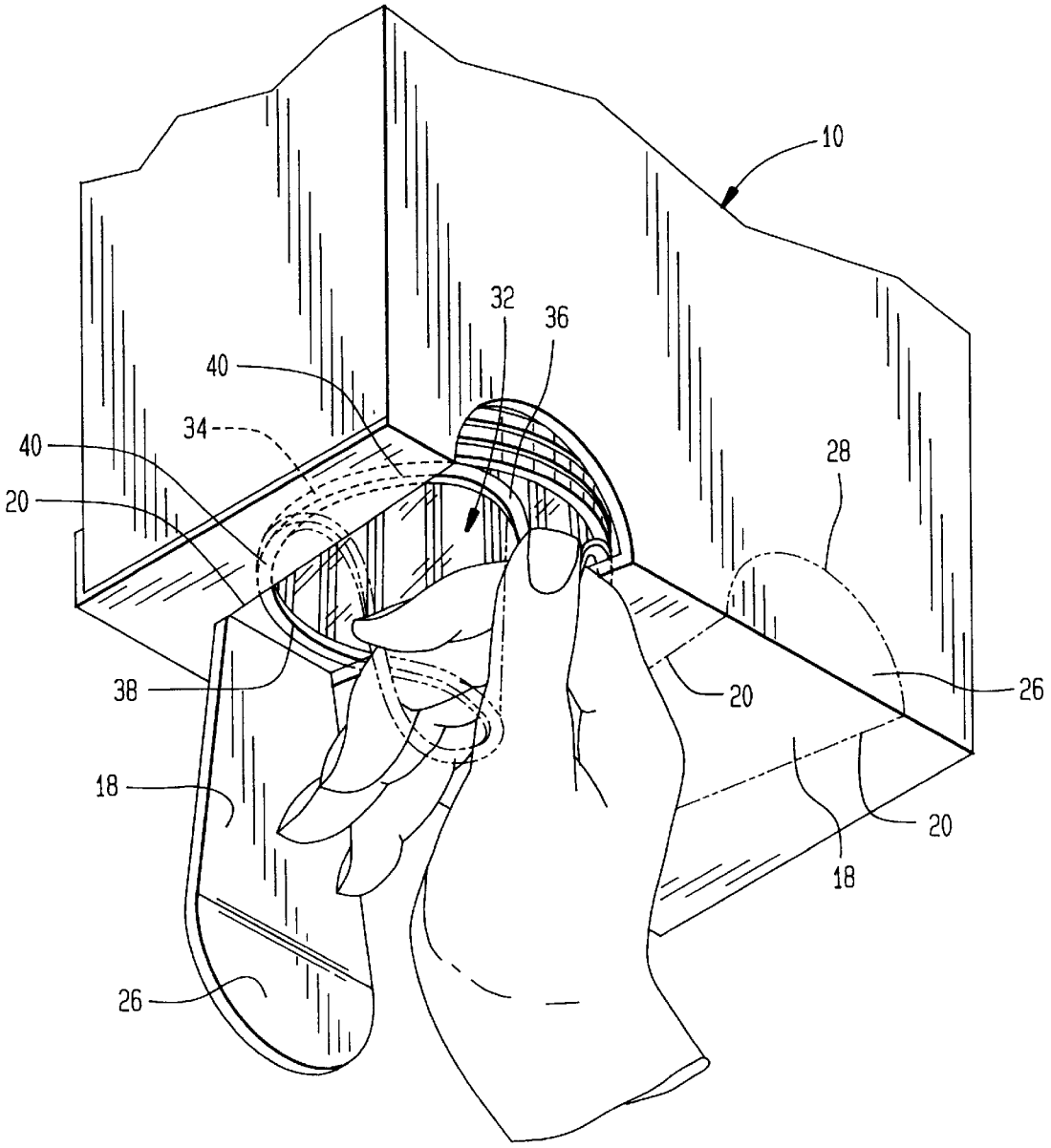
FIG. 3 is a perspective view viewed from the bottom of the dispenser of FIG. 1.

FIG. 3 illustrates the interaction of the dispensing opening and the dispensed liner 32 during the dispensing operation. The bottom aperture has a rhombus shape and the distance between the two perforated edges 20 is narrower than the diameter of the rim 34 of the nurser liner 32. The rim 34 of the nurser liner 32 is flexibly deformed as it is being dispensed as it passes through the constricted dispenser opening. Its circular configuration will become oblong, permitting it to egress through the restricted dispensing aperture or opening, as shown by a first position 36 in FIG. 3. As shown by second position 38, the perforated edges 20, that define the bottom portion of the dispensing aperture, guide the nurser liner 32 therethrough. As the liner 32 is being dispensed, portions 40 of the restricted dispensing aperture engage, but do not distort, the rim 34 of the next liner to prevent more than one liner from being dispensed. The grasp of the rim 34 along with the interaction between the dispensing aperture, especially the rhombus opening, and the rim 34 of the liner defeat the frictional adhesion between the liner being dispensed and the next adjacent liner.

In order for the nurser liner 32 to distort in shape as it travels through the bottom aperture, the nurser liner must be flexible relative to the edges of the bottom aperture so that the nurser liner, not the dispenser, will give in to the pressures due to the dispensing operation.

Figure 4:
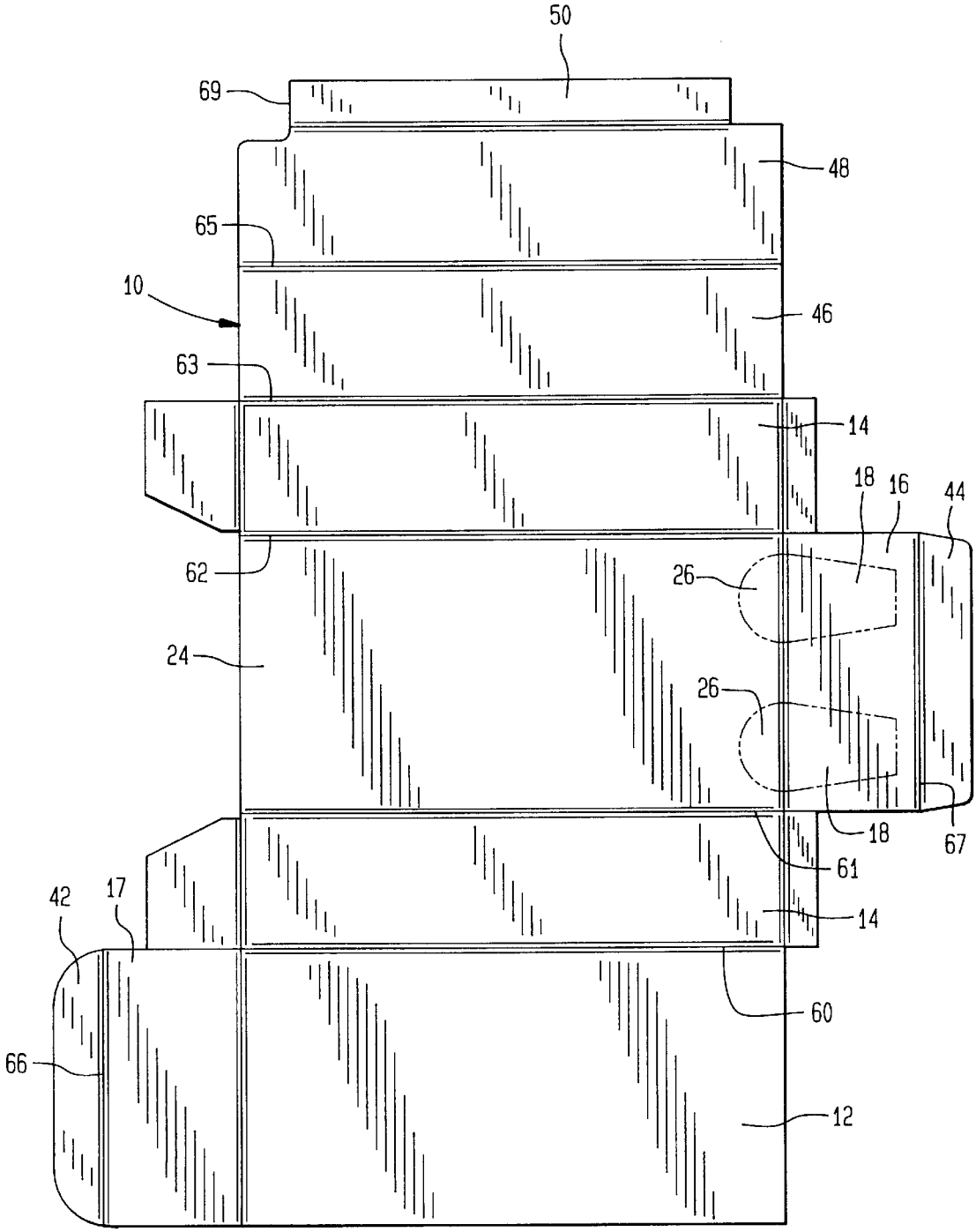
FIG. 4 is a planar view of the unassembled dispenser of FIG. 1.

Referring to FIG. 4, the dispenser 10 of the first embodiment of the present invention has a very simple design. It is a single and, preferably, integral piece of material, such as, for example cardboard. The back wall 12 is integrally connected along fold line 60 to one side wall 14 which in turn is integrally connected along second fold line 61 to the front wall 24. Analogously, front wall 24 is integrally connected along fold line 62 to the other side wall 14. Significantly, the other or second side wall 14 is connected along fold line 63 to a partition support 46 which in turn is integrally connected along fold line 65 to partition 48. There is preferably provided a connector flap 50 connected along fold line 69.

Alternative embodiments of the present dispenser 10 include a single piece of carton material that is either straight or reverse tuck. It is also envisioned, in a less preferred embodiment, that the dispenser 10 can be made of more than one single, integral piece of material, however it is believed that this will increase costs.

Figure 5:
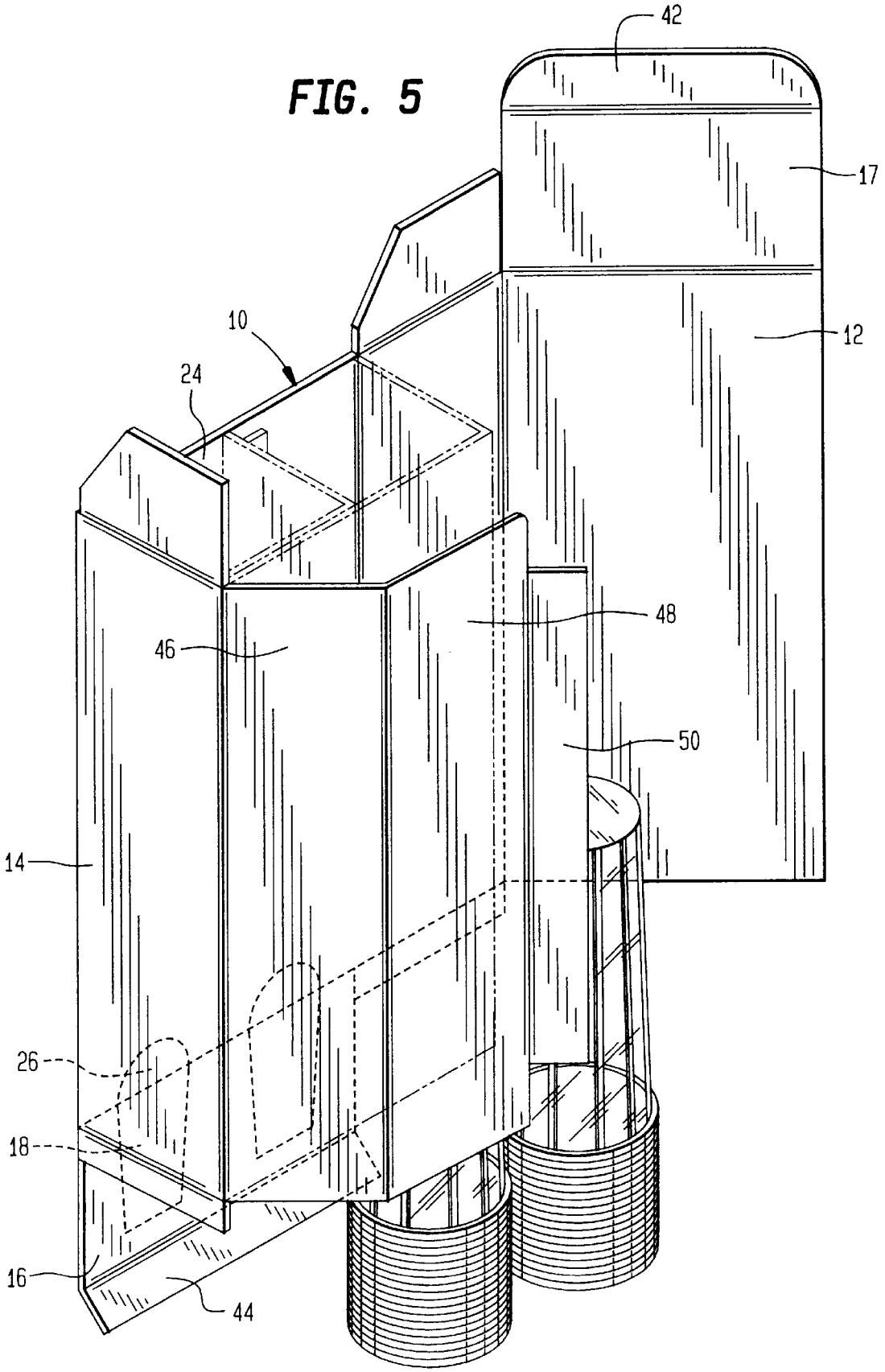
FIG. 5 is a perspective view of the dispenser of FIG. 1 with the back wall and support walls shown in two different positions.

As shown in FIG. 5, the partition support 46 is affixed, via any conventional means, such as, for example, adhesive, to the inside of a portion of the back wall 12 and the connector flap 50 is secured by the same conventional means to the inside of the front wall 24 so that partition 48 is positioned basically parallel to the side walls 14 to form two chambers for the two stacks 30 of liners 32. The two stacks 30 of nurser liners 32 are positioned next to each other, but separated by the partition 48 and thus enclosed in the dispenser 10.

Referring again to FIG. 4, a top flap 42 is integrally connected along fold line 66 to a top wall 17 of the dispenser 10. The bottom flap 44 is preferably affixed by conventional means, such as, for example, adhesive or glue to the outside of the back wall 12. This is preferred since it is easier to assemble during the production process. Alternatively, the bottom flap 44 may be inserted just inside the back wall 12 and secured in place by a tab (not shown). However, this involves additional steps and may not prevent contamination as provided by the sealed preferred embodiment.

Similarly, the top flap 42, which is integrally connected by fold line 66 to the back wall 12, is preferably inserted just inside the front wall 24, but alternatively it may be glued to the outside of the front wall 24.

The shape and dimensions of this dispenser 10 may conform to the shape of the nurser liner 32.

Preferably, the dispenser 10 is sized to contain approximately twenty-five disposable liners 32 per stack 30. More liners 32 can be accommodated per stack 30, or for that matter less liners per stack, by simply adjusting the height of the front, back and side walls.

The preferred dimensions of the dispenser 10 in its assembled condition to house twenty-five liners 32 per stack 30 is approximately 4.375 inches wide by 2.188 inches depth by 8.375 inches height (111.1 mm by 55.6 mm by 212.7 mm).

The dispenser 10 is preferably made of a material that has been approved under current FDA guidelines for use in food packaging. The preferred dispenser 10 is made of a commercial cardboard, such as regular density solid bleached sulfate. The preferred container has a basis weight ranging from 187 to 212 lbs./3,000 sq. ft., caliper ranging from 0.0172 to 0.0180 inches, machine direction stiffness ranging from 194 to 286 taber, and cross direction stiffness ranging from 90 to 150 taber. The dispenser 10 can be fabricated, die cut and glued, using conventional folding carton converting means, to deliver it in the flat/folded mode ready for processing.

Figure 6:
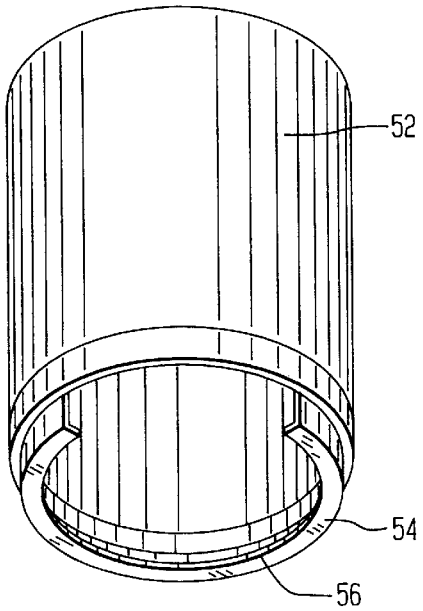
FIG. 6 is a perspective view of a second embodiment of the present invention.

A second embodiment of the present invention, shown in FIG. 6, includes a cylindrical housing 52 terminated with a constricted opening. The opening has a partial arcuate rim 54 whose inner diameter 56 is smaller than the outer diameter of a liner flange or rim (not shown). A portion of the rim 54 is removed to enable a portion of the flange to again be grasped by, for example, a thumb and a finger. This embodiment is not a preferred embodiment since it does not cover the exposed bottom opening and moreover is not conducive for two stacks 30 of nurser liners 32.

Figure 7:
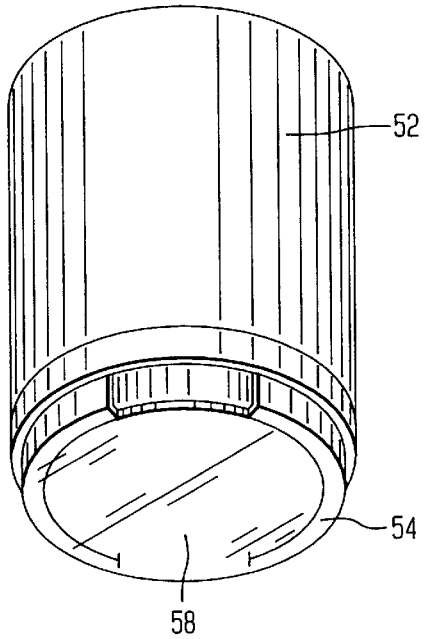
FIG. 7 is a perspective view of a third embodiment of the present invention.

A third preferred embodiment of the present invention, shown in FIG. 7, provides a cylindrical housing 52 similar to the second embodiment but includes a flexible flap 58 that covers most of the constricted opening. The partial arcuate rim is provided with a flexible flap 58, this being oriented to make use of what would otherwise be scrap material from their manufacture. In addition, the flexible flap 58 operates as a convenient cover that automatically closes, yet due to its elasticity, the flap is a negligible nuisance when dispensing the nurser liners 32.

Figure 8:
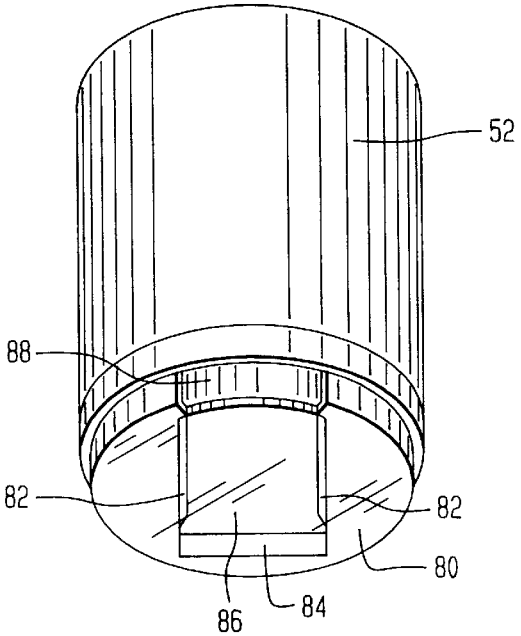
FIG. 8 is a perspective view of a fourth embodiment of the present invention.

A fourth preferred embodiment of the present invention, shown in FIG. 8, provides a cylindrical housing 52 including a near-diametrical slot having a hinged flap 86 provided at one end thereof. The dispensing aperture formed by the opening of the hinged flap 86 is substantially rectangular in shape, having two parallel sides 82 to guide a nurser liner through the aperture. When not in use, the hinged flap 86 may be closed by pivoting the hinged flap around hinge 84 and securely placing the flap handle 88 on an edge portion of the dispenser so that the hinged flap is flush with the rest of the hinged flap. This embodiment provides an inexpensive container for nurser liners that can be opened and closed in order to maximize the sanitary condition of the contents of the container.

Figure 9:
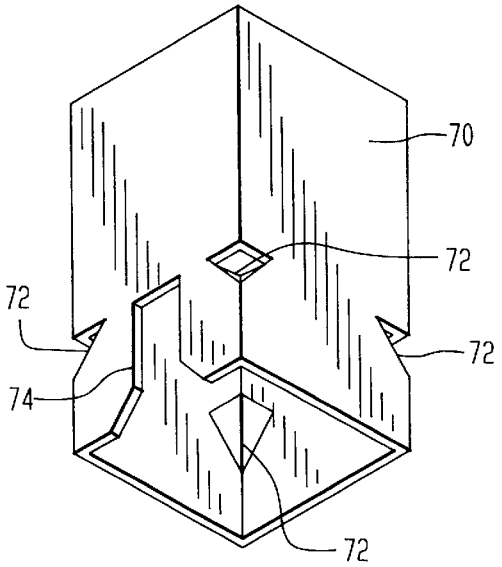
FIG. 9 is a perspective view of a fifth embodiment of the present invention.

A fifth preferred embodiment of the present invention, shown in FIG. 9, provides a rectangular carton or dispenser 70 in which its open terminus includes opposing protuberances integrally formed from tabs 92 folded from the walls of the dispenser. There is also provided a finger hole 74.

Each of these alternative embodiments, namely embodiments two through five, are preferably designed as integral structures. All, except for the fifth embodiment, use the aperture or opening in the bottom of the dispenser to both dispense one liner and disengage the other liners while maintaining them in dispensing position in the dispenser.

Referring to FIG. 10, the nurser liners held within the container 10 are stacked in a nested arrangement, that is one on top of another, to minimize space. As each nurser liner 32 is stacked on another liner, it creates random convoluted surfaces. This convolute action decreases the amount of surface area contact between the liners and, thus, the surface tension. Therefore, this stacking design facilitates separation of the nurser liners when dispensed.

It is also preferred that each rim of each nurser liner 32 be spaced slightly from the next adjacent rims to minimize the surface tension and, thus, facilitate separation. Each pair of adjacent rims 34 should have an allowable space, formed via a stacking lug 90, to facilitate separation, yet be as close as possible to minimize the amount of space needed in the dispenser 10. Each stacking lug 90 provides enough separation to permit a person's fingers to touch a rim during the separation process. It has been found that each stacking lug 90 creates a minimum space or separation of about 2.5 millimeters (mm).

The bead 80 on the liner 32 serves two purposes. It creates a seal between the liner 32 and the holder (not shown) when the liner is placed in the holder. In addition, it stops the liner 32 from rotating in the holder.

The present invention having been thus described with particular reference to the preferred forms thereof, it will be obvious that various changes and modifications may be made therein without departing from the spirit and scope of the present invention as defined in the appended claims.

Wherefore we claim:

1. A method for dispensing individual nurser liners from a stack of a plurality of nurser liners each having a flexible, circumferential rim at its open end, wherein the stack of the plurality of nurser liners is positioned in a dispenser having a bottom wall and a front wall each with a perforated edge portion, and wherein the perforated edge portions define a flap that selectively moves from a first position to a second position in which a dispensing aperture through the dispenser is exposed, the method comprises the steps of:

positioning said stack of the plurality of nurser liners vertically within said dispenser so that the rim of the lowermost one of the plurality of nurser liners is supported by the edge, grasping a portion of the rim of the lowermost one of the plurality of nurser liners by inserting a thumb through the perforated edge of the front wall and inserting another finger through the perforated edge of the bottom wall when the flap is in the second position;

withdrawing the portion outward through the dispensing aperture so that the remainder of the lowermost one of the plurality of nurser liners withdraws through the dispensing aperture subsequent to the rim, wherein the edge prevents the rim of the next lowermost one of the plurality of nurser liners from exiting through the dispensing aperture.

* * * * *